US008572772B2

(12) United States Patent
Wolf et al.

(10) Patent No.: US 8,572,772 B2
(45) Date of Patent: Nov. 5, 2013

(54) ELECTRONIC FAUCET WITH VOICE, TEMPERATURE, FLOW AND VOLUME CONTROL

(76) Inventors: James L. Wolf, Conifer, CO (US); Stephen O. Gregory, Denver, CO (US)

( * ) Notice: Subject to any disclaimer, the term of this patent is extended or adjusted under 35 U.S.C. 154(b) by 1088 days.

(21) Appl. No.: 12/205,794

(22) Filed: Sep. 5, 2008

(65) Prior Publication Data

US 2009/0056011 A1 Mar. 5, 2009

Related U.S. Application Data

(60) Provisional application No. 60/970,251, filed on Sep. 5, 2007.

(51) Int. Cl.
*E03C 1/05* (2006.01)

(52) U.S. Cl.
USPC ..... 4/623; 4/678

(58) Field of Classification Search
USPC ..... 4/623, 675–678; 251/129.04
See application file for complete search history.

(56) References Cited

U.S. PATENT DOCUMENTS

| | | | | |
|---|---|---|---|---|
| 4,735,357 | A | 4/1988 | Gregory et al. | |
| 4,762,273 | A | 8/1988 | Gregory et al. | |
| 5,549,273 | A | 8/1996 | Aharon | |
| 5,577,660 | A | 11/1996 | Hansen | |
| 5,625,908 | A | 5/1997 | Shaw | |
| 6,202,980 | B1 | 3/2001 | Vincent et al. | |
| 6,250,601 | B1 * | 6/2001 | Kolar et al. | 251/129.04 |
| RE37,888 | E | 10/2002 | Cretu-Petra | |
| 6,513,787 | B1 | 2/2003 | Jeromson et al. | |
| 7,350,245 | B2 * | 4/2008 | Giagni | 4/668 |
| 7,636,959 | B2 * | 12/2009 | Bowcutt et al. | 4/427 |
| 2006/0186215 | A1 * | 8/2006 | Logan | 236/12.2 |
| 2009/0000024 | A1 * | 1/2009 | Louis et al. | 4/676 |

FOREIGN PATENT DOCUMENTS

JP 05171665 A * 7/1993

* cited by examiner

*Primary Examiner* — Gregory Huson
*Assistant Examiner* — Janie Christiansen
(74) *Attorney, Agent, or Firm* — Kyle W. Rost

(57) ABSTRACT

An ergonomic water conserving faucet assembly that pivots around a cognitive central point providing touchless water temperature, flow rate, volume control and spray pattern adjustment through multiple, hygienic means. The assembly comprises a pivotable, ergonomic, ball-shaped spout that may be used statically or hand held; a retractable water delivery hose connecting the spout to a water source; a water mixing valve at the water source delivering water of preselected temperature; solenoid valves controlling flow; proximity and object detection sensors mapping the sink area and detecting input signals; speech sensors with microphone for voice control; an LED display of water temperature; internal speakers delivering audible prompts; and an electronic controller recognizing speech and supervising operations.

22 Claims, 10 Drawing Sheets

ELECTRONIC FAUCET WITH VOICE, TEMPERATURE, FLOW AND VOLUME CONTROL

BACKGROUND OF THE INVENTION

1. Field of the Invention

One aspect of the present invention relates to fluid handling and more specifically to faucets. Another aspect relates to automatic temperature regulation and more specifically to a device operated by a thermostat located in the fluid that is controlled, so that its own temperature controls its flow. In a further aspect, the invention relates to an electrically actuated valve. An electronic faucet is automatically controlled by object detection circuitry so that a user can start water flow through the faucet without any physical contact. The water faucet has touchless water temperature and flow adjustment 2. Description of Prior Art Electronic faucets are often located in public restrooms such as at airports or restaurants or at commercial washstands in medical institutions where it is important to maintain hygiene. These locations tend to be public rather than residential. In a largely public setting a faucet must operate in an intuitive manner since the user has no reliable means of learning detailed methods of operation. In typical operation, active infrared detectors in the form of photodiode pairs are used for various methods and in various locations for infrared detection of objects.

Faucets in public locations might perform the singular and relatively simple task of touchless "on" and "off" operation. Further, different brands of electronic faucets each will operate according to the different manufacturer's preferences, resulting in a lack of uniformity over control of any unusual abilities incorporated into such differently branded faucets. Consequently, in many public or commercial settings, the user knows only to place his hands near or below an electronic faucet and to hope he triggers a sensor that causes the faucet to operate in response.

Despite the practical inability to educate users of public faucets in more than fundamental operations, manufacturers have improved the operation and reliability of electronic faucets while maintaining simple, intuitive methods of control. Many electronic faucets employ infrared sensors for user input, because such sensors can detect the presence of the user, the presence of the user's hands below the faucet, or the presence of another object below the faucet. However, infrared sensors can malfunction due to the presence of unintended infrared sources. Various solutions anticipate the presence of changing infrared input levels. For example, U.S. Pat. No. 6,202,980 to Vincent et al. describes a sensor with a calibrated setpoint that automatically adjusts to follow changing infrared levels, only triggering the faucet when the level changes by too much to be accommodated by the normal tracking routine. The faucet avoids inadvertent operation, although the user is able to operate the faucet by the usual intuitive steps.

In addition to improved flow control, an electronic faucet can offer improved temperature control without requiring additional user training. For example, U.S. Pat. No. 5,577,660 to Hansen describes a system with multiple sensors communicating with a controller that compensates for lag time of hot water arriving from a hot water supply. As another example, U.S. Pat. No. 5,625,908 to Shaw describes a fully automated wash station that responds to the basic infrared sensor of the type that typically initiates water flow; but in this scheme the single actuation of that sensor also initiates automatic enhancements including the automated dispensing soap with the water stream for hand washing and the automated dispensing of a length of towel for drying the hands. By an alternate method of triggering the sensor, a knowledgeable user can cancel the enhanced functions to thereby obtain only potable water for drinking without the included soap ration and towel. Thus, the Shaw faucet accommodates users of increased knowledge by offering a simplified function, although the fundamental triggering of water flow together with the associated enhancements remains at the intuitive level to serve those users who are not informed of the alternate operational method.

The home environment offers the greatest challenge to the use of an automatic, electronic faucet. Commercial restrooms or wash stations typically offer a static environment in terms of ambient light conditions, while a home kitchen can be a dynamic environment where light source and intensity vary throughout the day, encompassing sunlight, fluorescent light, and incandescent light. U.S. Pat. No. 5,549,273 to Aharon proposed a kitchen-style faucet operated by a microprocessor and various sensors that could learn surrounding light conditions and adapt the threshold value for faucet actuation to the surrounding conditions. In addition, Aharon proposed two operational modes of water flow. In one mode, the flow operated in the basic "on" and "off" mode according to whether the sensors detected an object, while in a second mode the flow would remain on until signaled to stop. The latter mode was considered desirable for washing dishes.

A home user is more likely to desire and use an expanded feature set. A home user is likely to demand control over kitchen faucet water temperatures, flow rates and spray patterns, in addition to simple "on" and "off" operation or even an expanded "on" cycle. In-home users of kitchen faucets also have a general expectation of how such faucets should operate. The ability to swivel a kitchen faucet around a kitchen sink is a basic expectation. An automatic faucet requires greatly expanded sophistication to simply pivot over a typical double well sink basin without falsely being activated over the sink dam and, even worse, over the countertop behind the basin. False touchless temperature adjustments would occur simply when moving the faucet spout to a different location over the sink.

Some basic needs of a kitchen faucet have been addressed. The present inventors addressed the problem of a pivoting electronic faucet as described in U.S. Pat. No. 4,762,273 to Gregory et al., in which faucet positions are defined with respect to the faucet base. The angular positions that the spout can assume are identified as various zones. The zones are programmed to be active or non-active. Thus, a countertop could be in a non-active zone. According to the further U.S. Pat. No. 4,735,357 to Gregory et al., if the spout is turned by a preset angle to the side, the water flow is forced off for maintenance.

Several patents have proposed additional improvement in controlling flow and temperature in kitchen faucets. U.S. Reissue Pat. No. RE37,888 to Cretu-Petra proposes the use of two separate proximity sensors to individually control flow and temperature. The respective sensors detect a distance to the user's hands and adjust flow and temperature accordingly. In addition, Cretu-Petra proposes that a speaker and microphone might be incorporated into a faucet to allow oral commands controlling flow and temperature and to allow the faucet to issue oral status reports. Another disclosed feature is an electrode system enabling automatic filling of a washbasin and automatically shutting off water to prevent overflow. U.S. Pat. No. 6,513,787 to Jeromson et al. proposes the use of two related hand detecting sensors on opposite sides of a faucet, with the sensor on one side initiating an increase in water temperature and the sensor on the opposite side initiating a decrease in water temperature. A display of light emitting diodes (LEDs) on the faucet informs the user of the selected temperature.

Although such basic matters as temperature and flow have been controlled electronically, the promise of enhanced functionality by electronic control of a kitchen faucet remains substantially unrealized. As demonstrated in the above patents, a modern electronic faucet might offer the advantage of touchless operation, but this is only the most basic feature that electronics might offer. Few additional features are known. Touchless electronic temperature control, touchless electronic flow control, and swivel ability in a touchless faucet have presented technical challenges and limited solutions have been proposed. However, in mechanical faucets these features are well established, reliable, and so thoroughly expected that a homeowner is likely to reject any kitchen faucet that lacks such features, whether electronic or not.

For an electronic faucet to compete successfully with standard mechanical designs, it is evident that the electronic faucet must offer benefits both matching and exceeding those of typical mechanical faucets. The difficulty in expanding the electronic feature set includes development of sensible, easily learned operating methods. Some electronic faucets have resorted to a combination with manual mechanical control over certain standard features. As an example found in the Gregory U.S. Pat. No. 4,735,357, a manually actuated lever controls a spray wash through a conventional diverter valve. While it is commendable to incorporate standard and expected features in an electronic faucet, resort to manual levers adds little to recommend the electronic faucet over the prior mechanical designs and should be used with care and discretion.

In order for an electronic faucet to achieve success, it would be desirable to expand the scope and quality of touchless controls, as well as to provide an improved, real time technique for educating the user in methods of operating the faucet. Such known concepts as controlling flow pattern for swivel spout faucets, regulating flow rate, and setting temperature can be improved. Likewise, electronic faucets can be improved in the area of new functions that would be difficult to achieve in a purely mechanical faucet. In the area of controls, it would be a significant improvement to activate or deactivate manual and electronic controls as a function of real time faucet configuration so as to enhance the user's overall experience in operating the faucet. Altering the function of different controls can be especially effective in circumstances where the user must otherwise grasp a manual control or the faucet part carrying the manual control as an adjunct step to using a feature of the faucet.

It would be desirable to develop manual and electronic control schemes for converting known, purely manual systems, such as a spray wash, to a system operated with enhanced characteristics. Developing intuitive operational controls, or suitably instructing the user in real time, would be significant enabling achievements.

It would be further desirable to develop operational controls and methods capable of producing new and useful functions in a faucet. It would be especially desirable to introduce new functionality that benefits from electronic control, while being less suited to implementation by manual control.

To achieve the foregoing and other objects and in accordance with the purpose of the present invention, as embodied and broadly described herein, the method and apparatus of this invention may comprise the following.

BRIEF SUMMARY OF THE INVENTION

It is a general object of the present invention to provide a pivotable water supply system which allows for multiple input touchless activation of water flow, multiple input adjustment of water temperature, water flow rate, flow pattern and fixed volumes, through a removable spout head that also serves as a manual and touchless controlled hand held spray wash device, which affixes to a faucet stem that is cognitive of its position over a sink basin.

An ergonomic water conserving faucet assembly pivots around a cognitive central point and provides touchless water temperature, flow rate, volume control and spray pattern adjustment through multiple, hygienic means. The assembly includes a pivotable, ergonomic, ball-shaped spout that may be used statically or hand held; a retractable water delivery hose connecting the spout to a water source; a water mixing valve at the water source delivering water of preselected temperature; solenoid valves controlling flow; proximity and object detection sensors mapping the sink area and detecting input signals; speech sensors with microphone for voice control; an LED display of water temperature; internal speakers delivering audible prompts; and a microprocessor recognizing speech and supervising operations.

The faucet stem may be pivoted around its base and remains in cognitive reference to its position above the sink wells, interior dams and partitions, and sink perimeters. The ergonomic spout may be linearly removed from the faucet stem and when squeezed, used as a hand held spray wash. The retractable hose provides water flow from the mixing valve to the spout through the faucet stem and communication to a water control assembly below the sink. The water-mixing valve provides a user determined mix of hot and cold water through the hose to the spout and optionally a user specified and measured volume of water. The proximity sensors provide water temperature input signals corresponding to distance and duration at either right or left side of spout. The speech sensor provides similar input signals corresponding to user commands. The object detection sensor provides input signals to determine whether a hand or object has been placed in the field of view for rinsing or filling. The LED displays provide the user with feedback on actual vs. desired water temperature, mode of operation, and scalding water warning. The internal speakers provide feedback queries of unclear speech input signals and warn of scalding temperatures. The microprocessor is responsive to all values of water temperature, flow rates, volume delivery, spray patterns and "on" and "off" input signals from each of the proximity, speech, or "on" and "off" sensors The invention provides a standalone water mixing valve and electronic control interface adapted to receive touchless control instructions from a user. The mixing valve is connected by a hose and circuitry to a faucet assembly with removable spout that also serves as a hand held spray wash device. The removable spout contains both manually operated touch switches and touchless proximity and voice sensors that allow user adjustments of "on" and "off" operation, water temperature, flow rate, volume dispensing, spray pattern adjustment, and sink mapping unique to its installed environment.

In the preferred embodiment the water mixing valve, flow control valves, and the two water "on" and "off" solenoids (collectively the water control assembly) are located immediately below the countertop supporting the sink basin and faucet assembly. The water delivery electronic control interface is located proximate to the above-mentioned valves. Two water "on" and "off" solenoids allow water to flow through a normal full flow path and alternatively through a precision orifice for delivery of a measured volume of water.

The electronic control interface is adapted so as to be user controlled in at least one of several modes of operation at any given time, including at least, in-home setup mode, normal operating mode, safety mode, or hand held spray mode. The electronic control interface is also adapted to be in hibernate mode when no user is present, wherein only one touchless sensor is adapted to detect presence of the user within a predetermined distance from the spout to enable the faucet operations.

A flexible hose connects from the water control assembly through the faucet stem and into the removable faucet spout head. The hose allows for extension of the spout head by a comfortable distance for spraying objects in the sink basin. In the preferred embodiment the spout is shaped similar to a ball, allowing the easy grasp and movement of the spout to enhance the ability to direct the water flow without undo strain on the user's wrist or hand. This shape allows the user to directly remove of the spout from the stem by directly pulling straight back without rotating the wrist, which is distinctly different from a conventional spray wash of a typical kitchen faucet. The hose also contains means for communication from the control interface to the spout sensors.

In the preferred embodiment, the faucet spout head contains a manually operated button that is located on the front portion of the spout, which allows a user to activate "on" and "off" operation of water flow from the faucet. The manually operated button enables continuous water flow into the sink basin until water reaches a predetermined level below the sink perimeters or sink dam, whichever is lower, at which time the electronic control interface under software control will disable the continuous flow. When depressed for a predetermined duration, the manually operated button will enable in-home setup mode, allowing initial installation to be customized to its mounting and sink format.

In the preferred embodiment two manually operated pushbuttons are located on rear of the spout head at approximately the typical placement of either left or right forefinger of the user's hand. Depending on configuration, these switches are adapted to control additional faucet operations. One of these controls adjusts water flow rate, while the other control switches the outlet pattern of a water outlet nozzle in the spout between stream wash and spray wash patterns.

One sensor is attached in front of the spout aerator, facing downward toward the sink basin. The downward looking sensor is adapted to determine any distance between the spout aerator to the bottommost plane of the lowest sink well it is positioned over.

In one embodiment a sensor is located inside the base of the faucet stem such that when the faucet is rotated, the sensor may communicate its angular position to the control interface. This function may be replaced by an accelerometer, which can estimate the angular position when combined with the downward facing sensor to determine the limits of sink dams.

When functioning in in-home setup mode and rotated from its leftmost to rightmost positions over the sink basin, the downward looking sensor will communicate the distances from the sensor to the topmost plane of various objects permanently installed in the sensors field of view, i.e., countertops, sink wells, sink dams, etc., to the control interface, which will memorize these relationships. The downward looking sensor is adjusted so as to disable "on" and "off" operation should an object be presented closer than a predetermined distance from the spout. The mapping relationship is utilized to determine if an additional object has entered the field of view of the downward facing sensor to enable the automatic water dispensing operation.

Two distance measuring sensors are located looking horizontally outward approximately at 30 degrees with respect to the centerpoint of the spout, one to the right side and one to the left side of the faucet spout. These sensors are used to determine the presence of a person in front of the spout and to deactivate hibernate mode. The leftmost outwardly looking sensor will detect an object within a predetermined distance from the spout to provide user desired water temperature adjustments from cold to hot, depending on the duration of time an object is in front. Likewise the rightmost outwardly looking sensor will detect an object within a predetermined distance from the spout to provide user desired water temperature adjustments from hot to cold. The two sensors are adjusted so as to disable temperature adjustment should an object be presented closer than a predetermined distance from the spout, i.e. if the user grasps the spout as for hand held use.

An array of colored LEDs is located across the front of the spout and indicates the approximate temperature of water as determined by the user. At least one of the LEDs will flash and optionally an audible alert will be presented when actual emerging water reaches the selected temperature. While in normal operation with scald sensing enabled, all of the leftmost LEDs will flash when the emerging water temperature exceeds a predetermined safe level such as 117 F. degrees, and safety mode will be entered. While in this mode a delay will be imposed to the automatic "on," but not manual "on" operation of the faucet for a predetermined duration regardless of the source of any touchless control input. When touchless controls either sense a hand or object within the predetermined distance of the downward looking sensor or receive instruction from the voice recognition sensor, the safety mode will enable at least one audio signal to warn the user if water is about to emerge at a temperature exceeding the safe temperature. The electronic interface control will disable safety mode and revert to normal operation mode after water temperature falls below the safe temperature level.

In the preferred embodiment, a solenoid operated spray wash valve is located in the faucet spout head. The spray wash solenoid is capable of changing the emerging water flow pattern from stream flow pattern to spray flow pattern, or conversely, from spray flow pattern to stream flow pattern. "On" and "off" operation of the spray wash valve is controlled by differing means depending on whether the spout head is affixed to the faucet stem or held by hand.

The faucet spout head contains both a voice recognition sensor and a speaker, which are used to activate functions by voice command and to interact with the user. The voice recognition sensor is adapted to receive user input commands for water temperature, flow adjustment, flow pattern, volume dispensing, and other functions. The speaker will audibly warn the user of emerging water temperatures exceeding a safe level such as 117 F. degrees, provide prompting when necessary, and advise the user of unclear commands.

When the spout head is affixed to the faucet stem, the voice recognition sensor controls "on" and "off" operation of the spray wash valve. The spout head is removable from the faucet stem. Once it is removed from the faucet stem, the hand held spray mode is enabled, which defaults to alternative control by voice or by the dual manual pushbuttons located on the rear of the spout head. When the spout head is removed from the faucet stem, the in-home setup mode and normal operation modes are disabled.

Additionally, the electronic control interface disables both of the outwardly directed touchless temperature adjustment sensors to prevent the hand holding the spout from inadvertently changing the water temperature. Similarly, the downwardly directed touchless "on" and "off" sensor is disabled such that objects below do not inadvertently activate the flow. However, the safety mode continues to function when the spout is removed.

The accompanying drawings, which are incorporated in and form a part of the specification, illustrate preferred embodiments of the present invention, and together with the description, serve to explain the principles of the invention. In the drawings:

DETAILED DESCRIPTION OF THE PREFERRED EMBODIMENT

Figure 9:
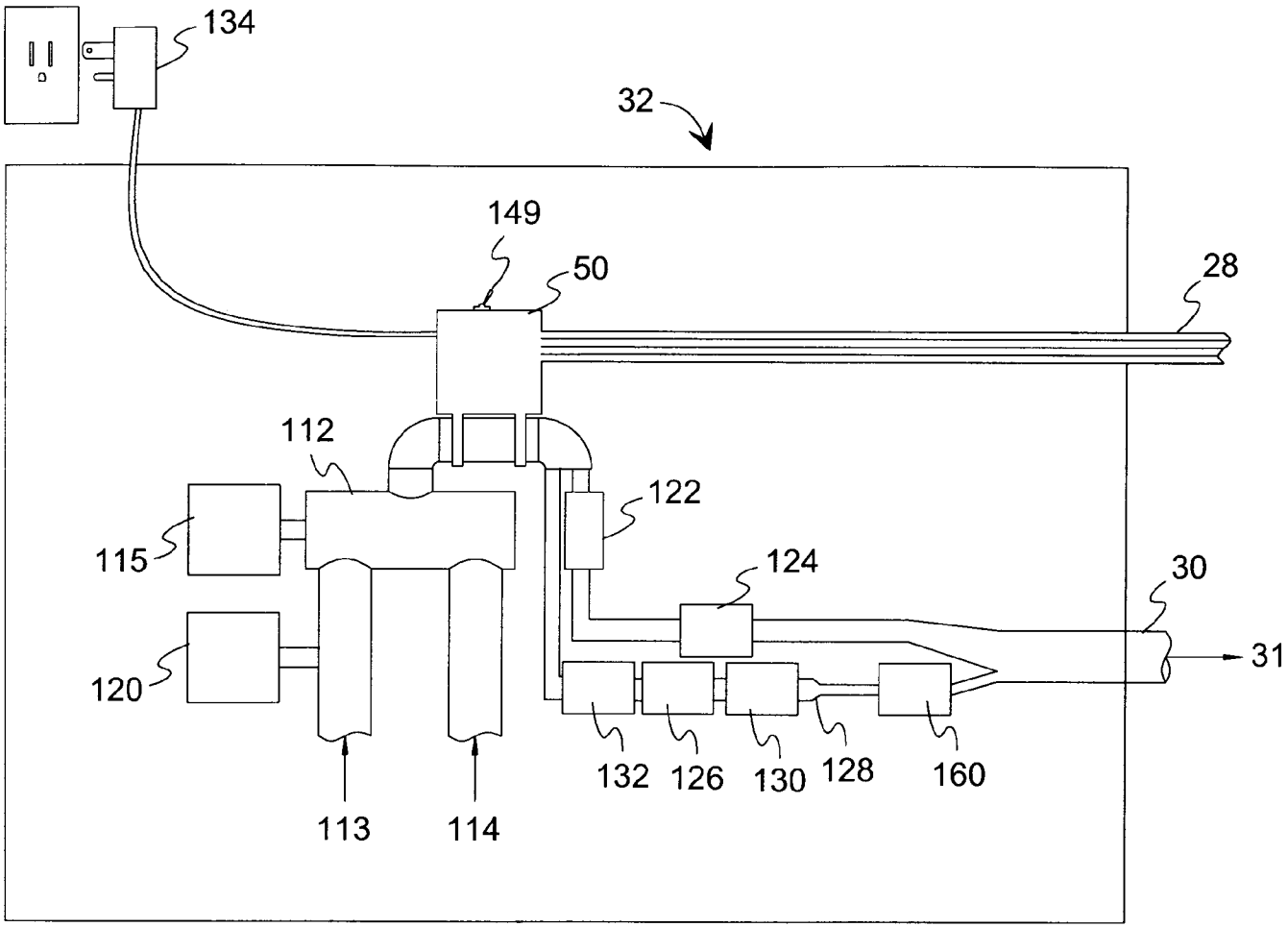
FIG. 9 is a schematic view of the water control assembly.

The present invention provides for an ergonomic, water conserving faucet assembly comprised of three primary components. With reference to the drawings, the first is an extendable and retractable spout head (20). The spout head is of a unique ergonomic shape made for mating with and detaching from the second component, which is a stem (22). The stem has a pivot base suited for fixed attachment at a receptor opening in an underlying surface such as a counter or a sink perimeter shelf, as known for mounting faucets. An upwardly extending, pivoting portion of the stem pivots with respect to the base. Thus, the pivoting stem moves around a central point at the back of a sink (24), moving the spout through an arc. The spout head (20) provides a water connector (26) that mates with a complementary junction at a head end of stem (22) to support the spout head in home position on the end of the stem. In addition, the spout head (20) is joined to wires, cable, or other electrical connections (28) that are routed through stem (22) with a water conduit (30) to a water control assembly. The spout head (20) is operably connected to a water conduit such as hose (30) extending through stem (22) and suited to deliver a flow of water (31) through the spout head. The third component is a water control assembly (32) that typically is mounted below the sink, as shown in FIG. 9. The hose (30) extends between the water control assembly (32) and the spout head (20) for delivering a supply of water (31) to the spout head. This combined faucet assembly provides touchless adjustment of water temperature, flow rate, volume control and spray pattern through multiple, hygienic means including the use of a human hand (34), the use of an object (36) such as a dish in a sink, by proximity, and by voice control.

Although a sink or counter is anticipated and accommodated in the installation and operation of the faucet, these do not constitute elements of the invention. Likewise, although a human hand (34) or other object (36) to be detected is anticipated to be in proximity to the faucet and to influence faucet operation, these do not constitute elements of the invention. Further, although a source of hot and cold water is anticipated to be present to supply water to the faucet, it does not constitute an element of the invention. While these elements will be mentioned for their interaction with the faucet, it should be understood that they are mentioned in order to provide a full and clear description and not to incorporate them as parts of the invention.

Figure 5:
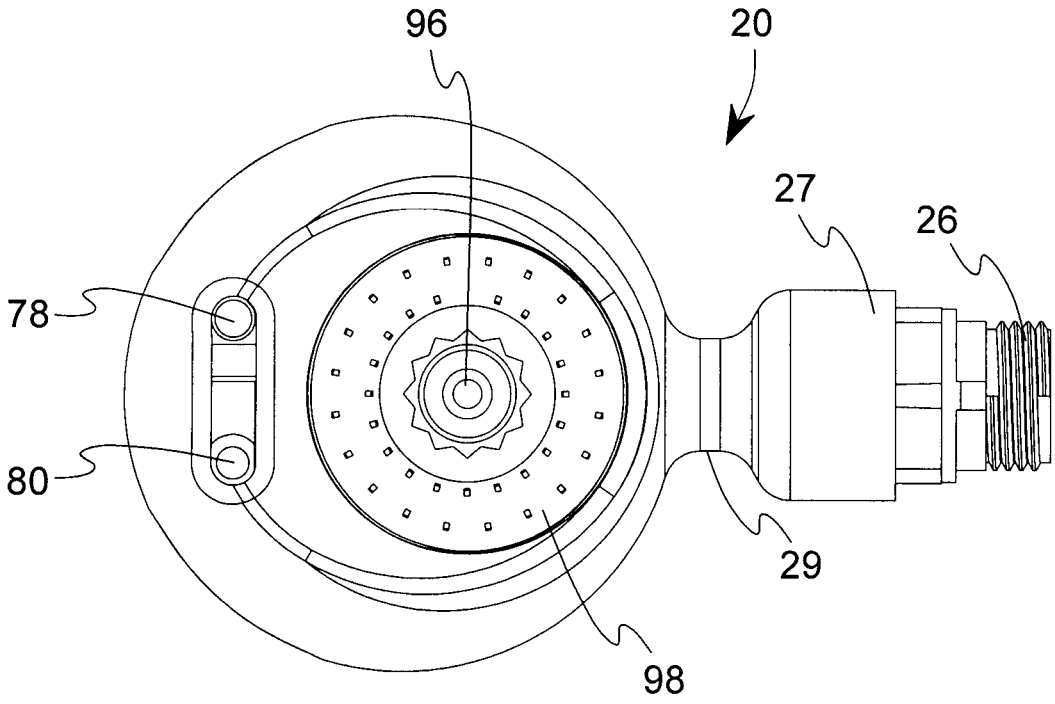
FIG. 5 is a bottom view of the spout head showing the spray wash port and the downward facing sensor.
Figure 6:
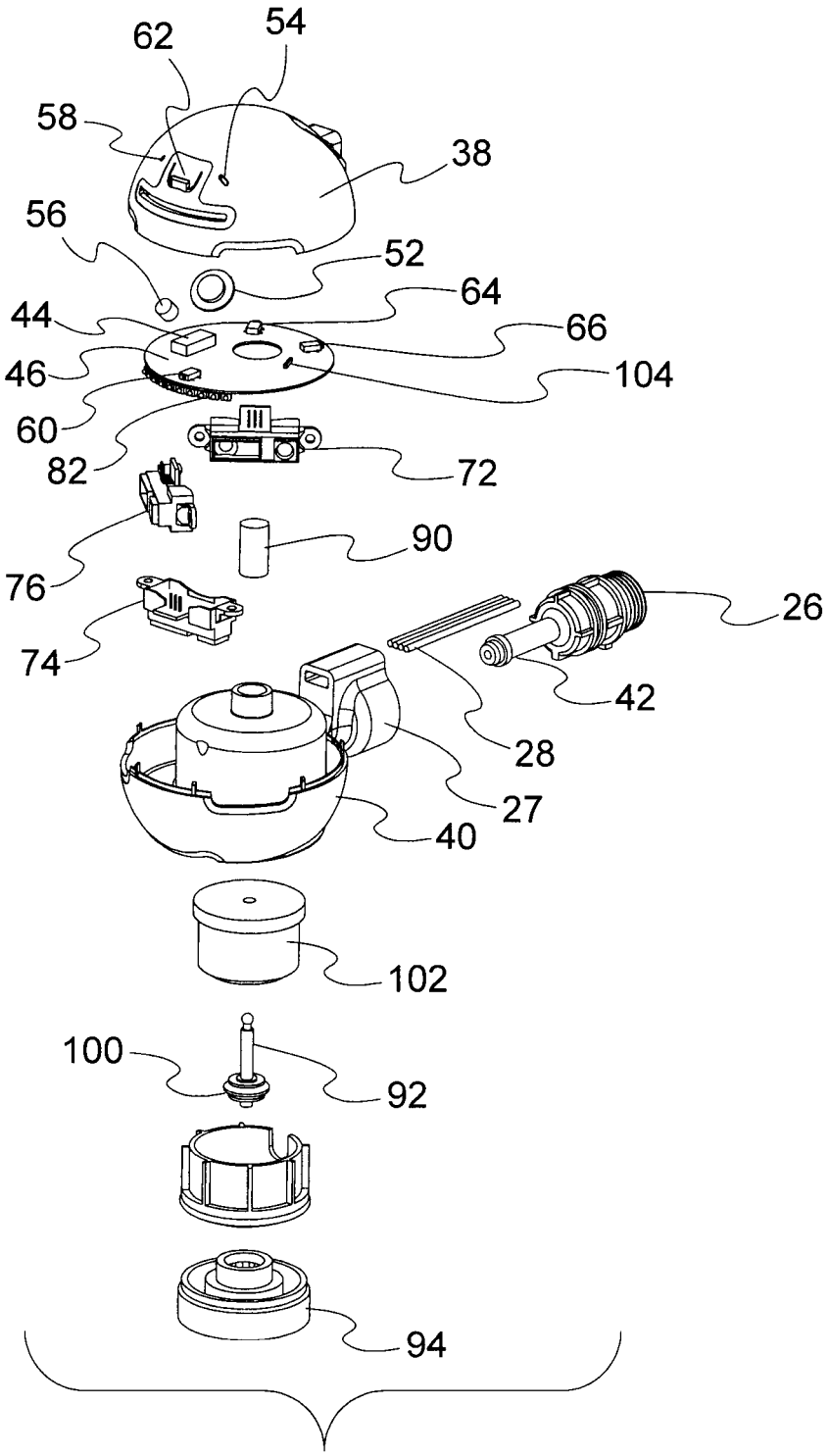
FIG. 6 is an exploded view of the spout head assembly showing various internal components.
Figure 7:
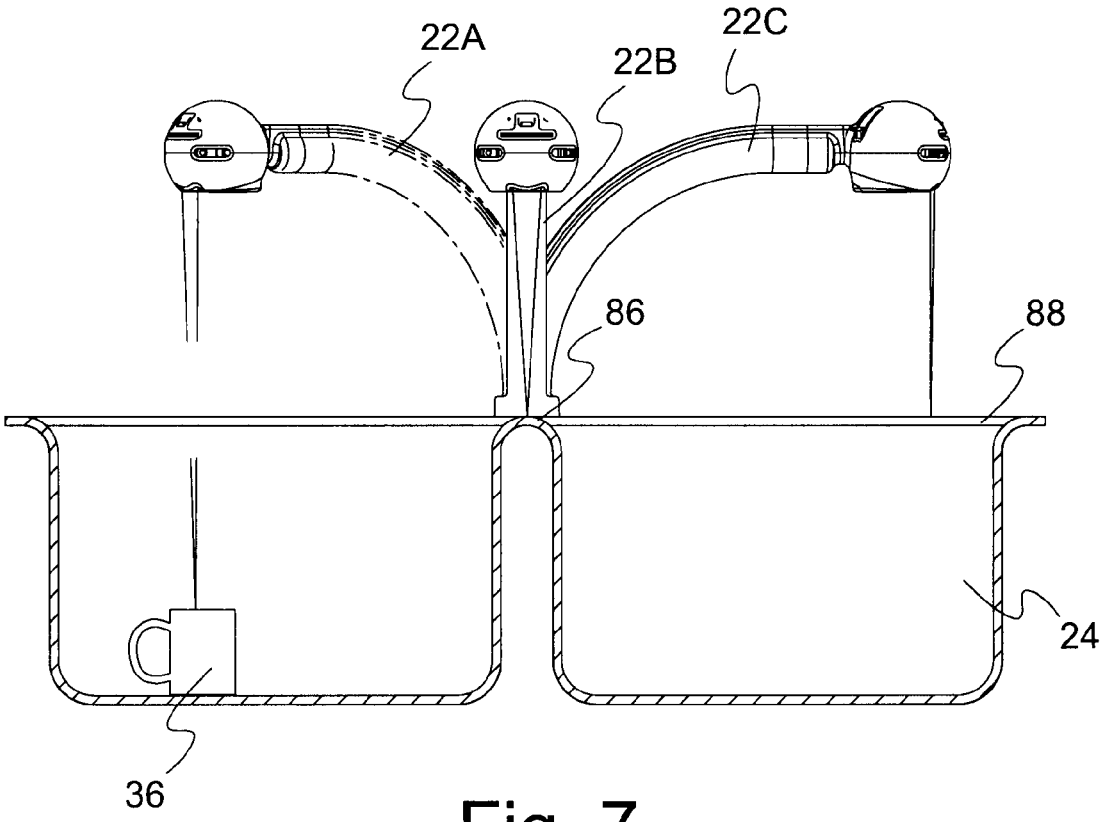
FIG. 7 is a front view of the faucet mounted to a sink, showing the faucet in three different rotational positions, and showing a downward sensor field detecting the distance to a different object in each faucet position.

The spout head (20) is composed of an upper plastic shell (38) and a lower plastic shell (40) containing a water passage (42) that serves as an extension of water conduit (30) from connector (26) into the spout head (20). As shown in FIG. 6, a water supply connection provides a connector (26) that is mounted in a connector shell (27) on the rear face of the spout head (20). As shown in FIG. 5, the water supply connection includes a tapered neck (29) in connector shell (27) at its junction with spout head (20). The spout head (20) contains an electronic controller or microprocessor (44) that operates suitable software constituting a voice recognition engine. The microprocessor (44) and other electronics are mounted to a printed circuit board (46). Microprocessor (44) is primarily responsible for interfacing to a user through various sensors, switches and speech interaction.

A water control electronics package (48), typically mounted under the sink, supplies power to the spout electronics through wires (28). The spout processor (44) communicates with another electronic controller (50) in the water control electronics package. Water control electronics microprocessor (50) may communicate via a digital protocol such as the I2C protocol over wires (28), as shown in system block diagram of FIG. 10. This under-sink water control microprocessor (50) is responsible for making all command decisions and maintaining safety for delivery of water based on input from the spout microprocessor (44).

The spout head (20) additionally contains a speaker (52) with associated speaker port (54) to provide audible alerts including speech output and a microphone (56) with associated port (58) to provide speech input. These are connected to the specialized speech microprocessor (44), which may be a suitable electronic controller manufactured by Sensory Inc., of Sunnyvale, Calif. This processor contains specialized circuitry and algorithms for recognizing and producing speech. The processor (44) and microphone (56) constitute a voice recognition sensor.

A manual water flow activation switch (60) operated by button (62) on the front of the spout is interfaced to the microprocessor (44). The button (62) and switch (60) manually control the delivery of water by momentary operation. By special actuation such a prolonged pressing of button (62), switch (60) manually controls entry into setup mode. Two switches (64, 66) on the rear of the spout and associated buttons (68, 70), which are adjacent to the tapered neck (29) of water conduit connector shell (27), are utilized to manually control the flow rate of the water delivery, optionally control the temperature and activate other functions when used in combination. For example, button (68) operates switch (66) to lower flow rate, while button (70) operates switch (64) to raise flow rate.

The spout head (20) additionally contains three distance measuring infrared proximity sensors (72, 74, 76). Sensor (76) faces the front left, while sensor (72) faces front right. Much of the faucet electronics may enter an economical hibernate mode when not used for a period of time. Under processor control, one or more of the sensors may reactivate the electronics to normal operational mode upon detecting a user within a specified distance range, such as eighteen to twenty-four inches, after a period of hibernation. These two sensors (76) and (72) are positioned to detect the presence of a user in front of the spout to enable automatic touchless operation and voice interaction.

The electronic controller operates sensors (76) and (72) to touchlessly control water temperature when hands (34) are placed directly in front of these sensors. The left sensor (76) is used to lower the temperature and the right sensor (72) is used to raise the temperature at a predetermined rate as long as proximity is maintained. The electronic controller operates the sensors to avoid false signals. If a sensor detects that a hand is placed too close to the sensor, such as within two inches, or too far away, such as over four inches, the electronic controller will cause a default response by setting a lukewarm water temperature. Thus, the proximity sensors require a steady signal from a predetermined distance range in order to touchlessly regulate water temperature other than by default.

As best shown in FIG. 5, each proximity sensor (72, 74, 76) is a combination of a specialized infrared transmitter (78) with a position sensing infrared receiver (80), both of which are available from Sharp Electronics Corporation of Camas, Wash. An array of ten two color LEDS (82) are used to represent the current temperature settings and other conditions explained below. The LED temperature display indicates actual versus desired temperature settings. The array of LEDs in series represents a spectrum of temperatures. Once the user sets a temperature, either by touchless command or manually, that desired an LED that is steadily lit at a proportionate location in the array indicates temperature setting. A flashing LED at a proportionate location in the array displays the relative actual water temperature. The position of the flashing LED moves along the array until arriving at the position of the desired steady LED, thereby visually informing the user that the desired temperature has been reached. In addition, the speaker emits an audible signal notifying the user that water of the desired temperature is now at the spout.

The downward facing front sensor (74) is suitable to sense the distance to detected objects or surfaces. Thus, sensor (74) can be regarded as a height or distance detecting means that senses the distance to the highest and lowest planes of static structures below the faucet spout. This sensor (74) is utilized to detect an object (36) such as a cup or dishes interposed in the field of view of sensor (74) at a suitable height to activate water flow. Sensor (74) is also used in an in-home setup mode to assist in mapping the static contour of the underlying surface proximate to where the faucet is installed. Typically, the underlying surface will constitute a sink establishing a low plane at the bottom of the sink basin and a countertop establishing a high plane. These contours or heights are mapped to create a window of allowable automatic operation between the high and low planes. The sensor (74) communicates with electronic controller (50) and during setup mode supplies data indicating the mapping or sensed contours as the stem (22) pivots through its arc. The electronic controller retains the mapping data for subsequent reference when the electronic controller is in normal mode.

When operated in normal operational mode, the sensor (74) supplies data to the electronic controller indicating the height of a sensed object other than the mapped surfaces to the processor (50). With additional data received from a means for sensing the angular position of the stem with respect to the stem mounting base or sink, the electronic controller is able to refer to the established map of contours and determine when a sensed object is within the window of allowable automatic "on" and "off" operations relative to the mapped contours. The electronic controller operates sensor (74) to avoid false signals. The controller and sensor respond to an object within the window for automatic "on" and "off" operations when the object remains relatively motionless for at least a short period of time, such as a half second. During water flow, sensor (74) under processor control also monitors water height in a mapped sink basin to shut off water flow at a predetermined maximum water height, thereby allowing automatic filling while preventing overflow.

Figure 8:
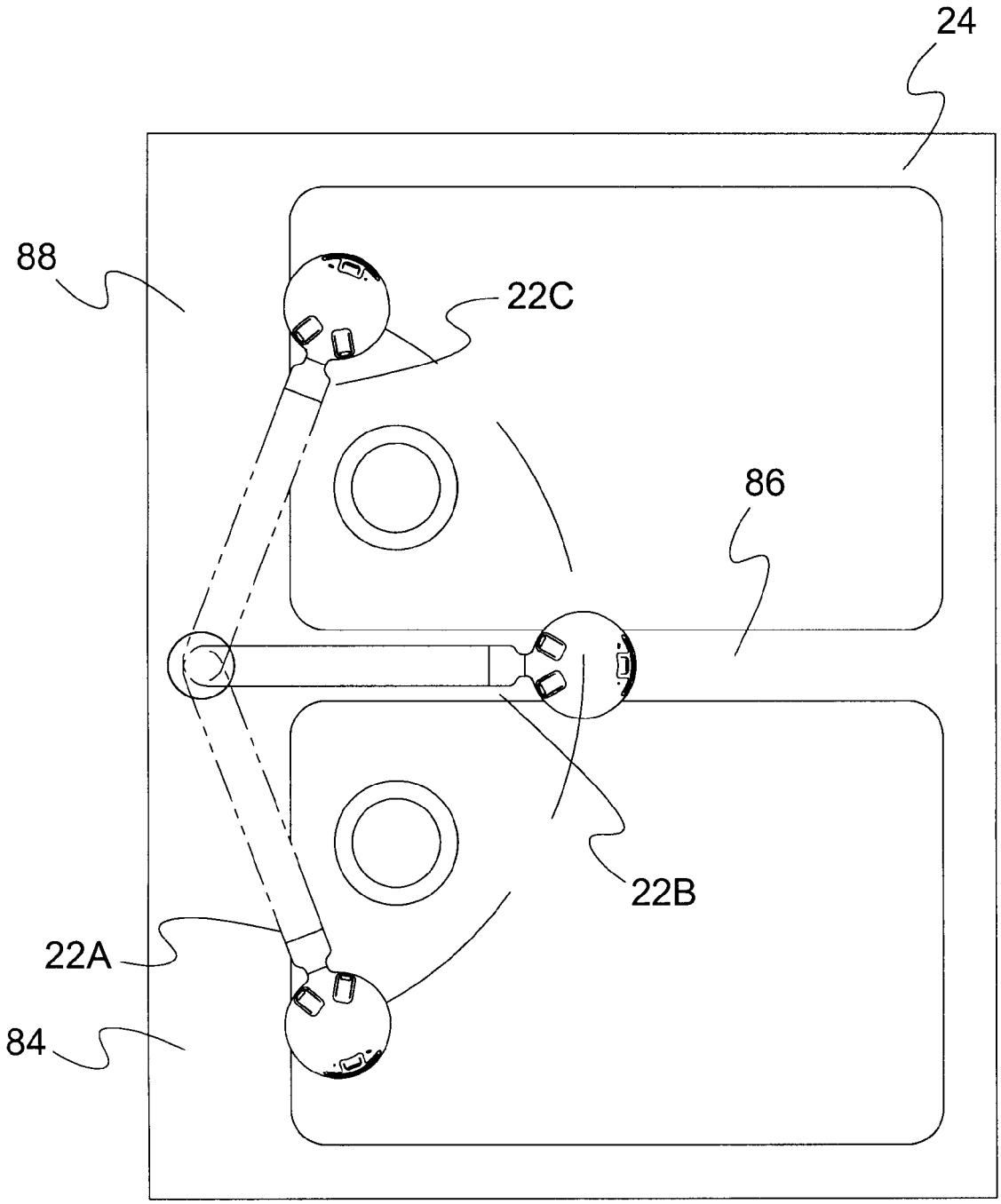
FIG. 8 is a top view similar to FIG. 7, showing the faucet mapping sink depth at different angular positions.

FIG. 8 shows the faucet stem (22) at three positions (22A, B, and C) as examples of deployment of the faucet stem in three representative mapping positions around a sink (24). With the faucet stem (22A) in left position, sensor (74) maps the left counter (84) as a fixture signifying a left limit. With the faucet stem (22B) in central position, sensor (74) maps the central dam (86) at the central position. With the faucet stem (22C) in right faucet position, sensor (74) maps the right counter 88 as a fixture at the right limit.

Mapping in setup mode establishes a known baseline of angles and heights or distances to surrounding, static features, enabling the electronic controller to determine a dynamic field of faucet operations. The electronic controller has a record of the static structural contours and angular positions of external features such as the usual sink in proximity to the faucet. The electronic controller (50) employs this data to control availability of water flow as a function of stem position or as a function of other object detection. For example, in normal mode the processor will not allow water to flow when the faucet stem is over the left or right counter. The processor will not start water delivery merely because the stem is over a sink dam that has been mapped. The processor will allow water delivery when an external object is detected in a suitable position, such as between a sink basin contour and at a predetermined top distance below the sensor.

The spout (20) also contains a spray solenoid (90) for operating a spray/stream diverter valve (92) and multi-function nozzle (94) offering at least two outlets of differing flow patterns on the bottom face of the spout. For example, when activated through either voice command or with the proper switch sequence, the valve (92) changes the flow route through the nozzle (94) between normal stream flow and spray flow. Normal stream flow is through a first, central nozzle area (96), while spray flow is through a second, outer nozzle area (98). Spray is accomplished by diverting the flow at diverter valve (92) from normal stream flow outlet passage (96). Diverter valve (92) travels vertically between two positions operated by the solenoid (90). At one end limit of travel, a rubber diaphragm (100) blocks the flow of water through the outer portion (98) of nozzle (94) by pressing against upper valve seat (102), forcing water through the center (96) of nozzle (94) in a normal stream wash flow pattern. In the opposite position, diaphragm (100) seats against the center of nozzle (94) and forces the water to flow through the outer portion (98) of nozzle (94), through spray orifices.

Input from the various sensors to the processors allows the faucet to operate in several distinct modes. One of the modes is a setup mode. In this mode, the faucet maps its installation surroundings and is adjusted to user preferences as described, above. Another user selectable preference is a verbal mode wherein the faucet gives verbal confirmation or warning of each selected faucet function. For example, the faucet verbally confirms selected temperature, selected flow rate, and selected spray pattern, in addition to any other verbal message that is normally provided. Scalding water warnings are always given verbally and automatic flow is delayed for a short period such as one and one-half seconds. The verbal mode is particularly useful for a blind user.

Another mode is normal operational mode. In this normal mode, the spout is in home position, carried on the stem. In addition to the manual touch switches, the faucet sensors are actuated to allow touchless operation over flow, temperature, volume and other normal operational functions. In normal mode, both proximity sensors and voice control and operable.

A third mode is hand held spray mode. In this mode, the buttons, switches, or other manual touch controls on the spout operate the spout, typically without the proximity sensors. The spout sensors are reassigned new functions to accommodate hand held spray mode by preventing the presence of the user's hand on the spout from inadvertently triggering a change in spout operation. These new functions may be to deactivate the infrared sensors or to place the sensors in an idle state. In either case, the infrared sensors are prevented from functioning to cause unintended changes in water temperature, flow rate, or flow "on" and "off" status due to the presence of the user's hand on the spout. Voice instruction may continue to be functional in spray mode. Other automatically controlled modes such as safety mode and hibernate mode are described elsewhere.

Figure 1:
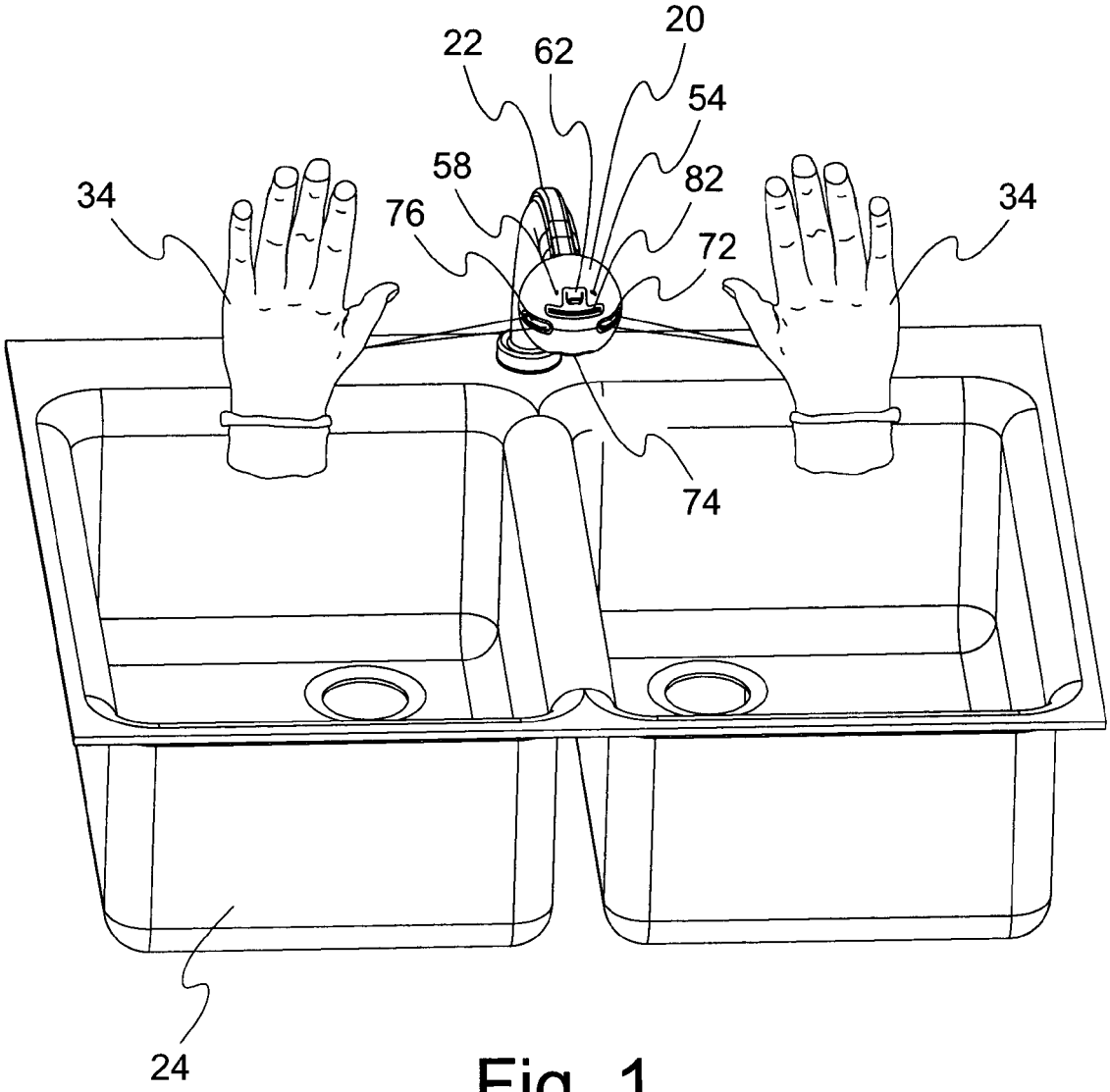
FIG. 1 is front isometric view of the faucet with spout head attached through the stem to a sink with a users hands in front of the forward facing sensors, showing representative locations of key components in the spout.
Figure 2:
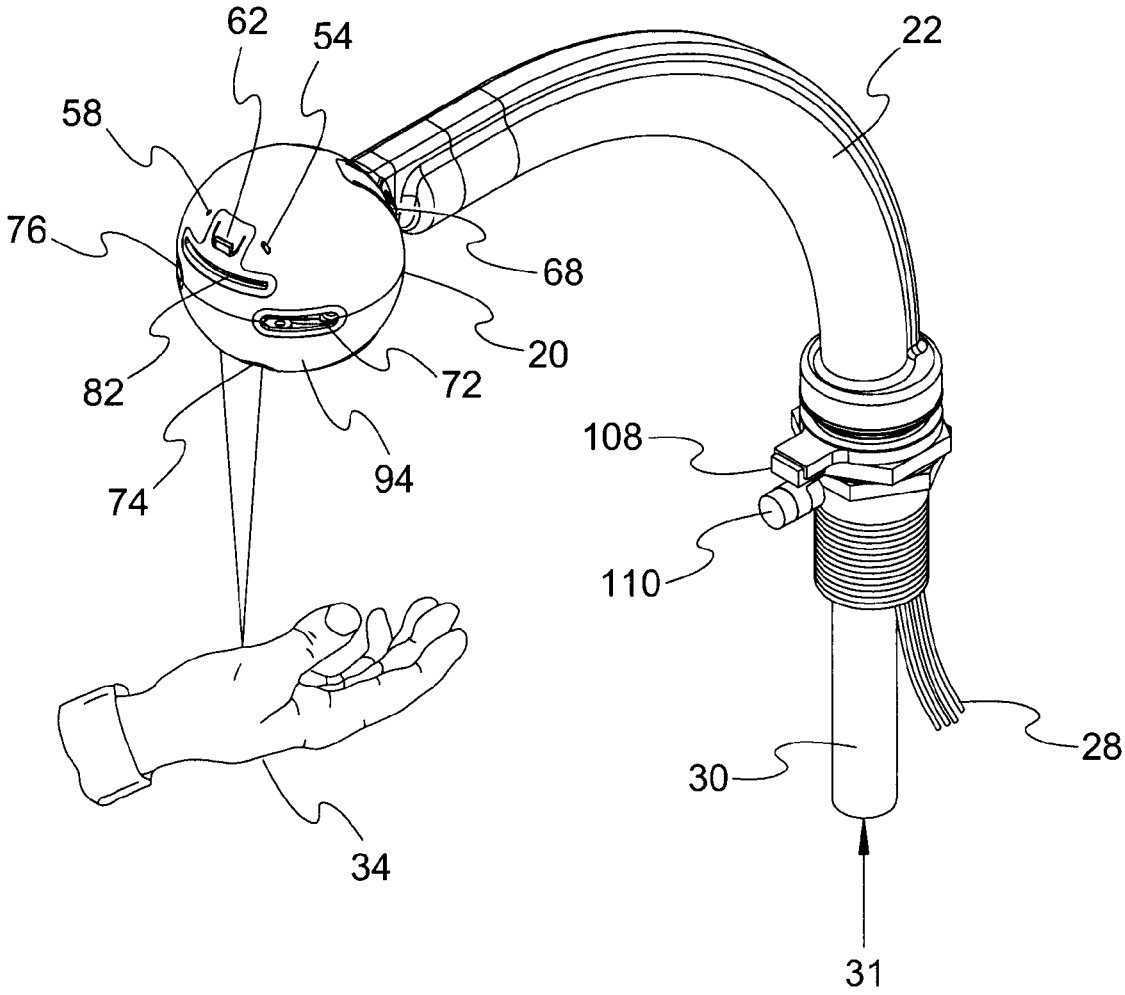
FIG. 2 is a right side isometric view of the faucet, showing detail of the spout head and stem.
Figure 3:
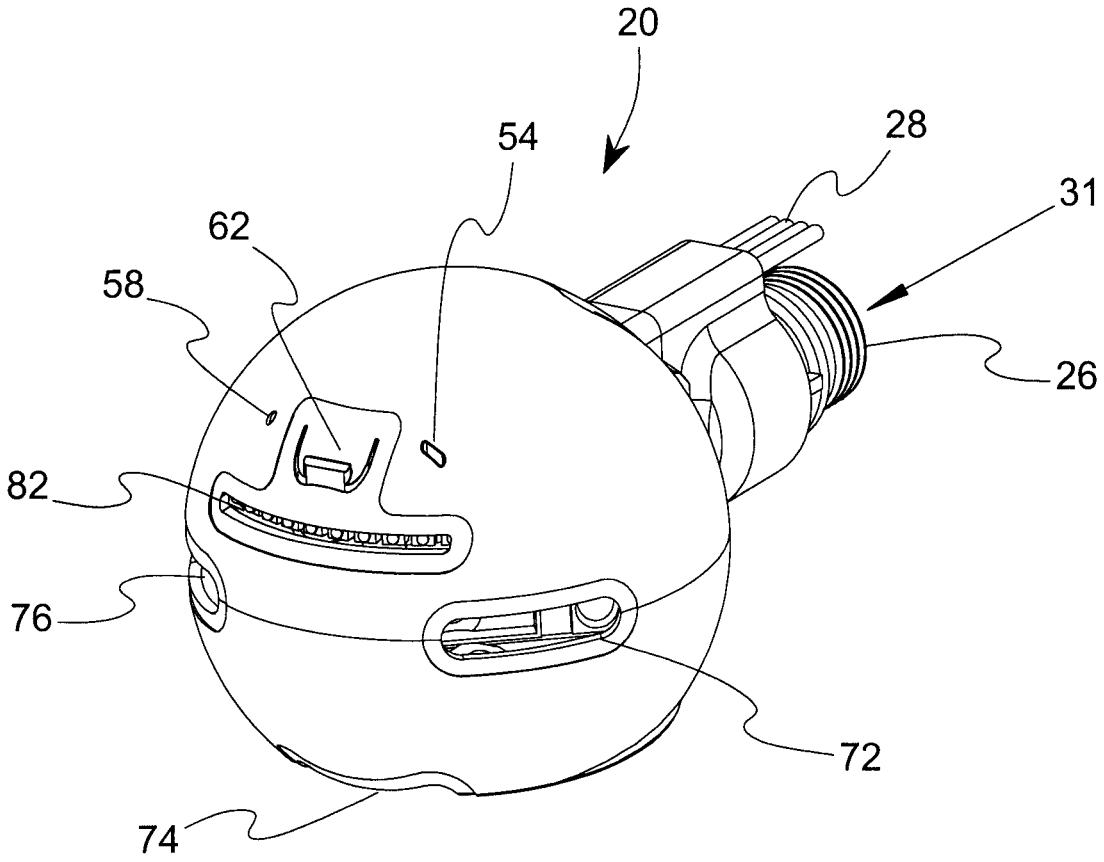
FIG. 3 is a front right isometric view of the spout head showing connections for a water hose and wiring.
Figure 4:
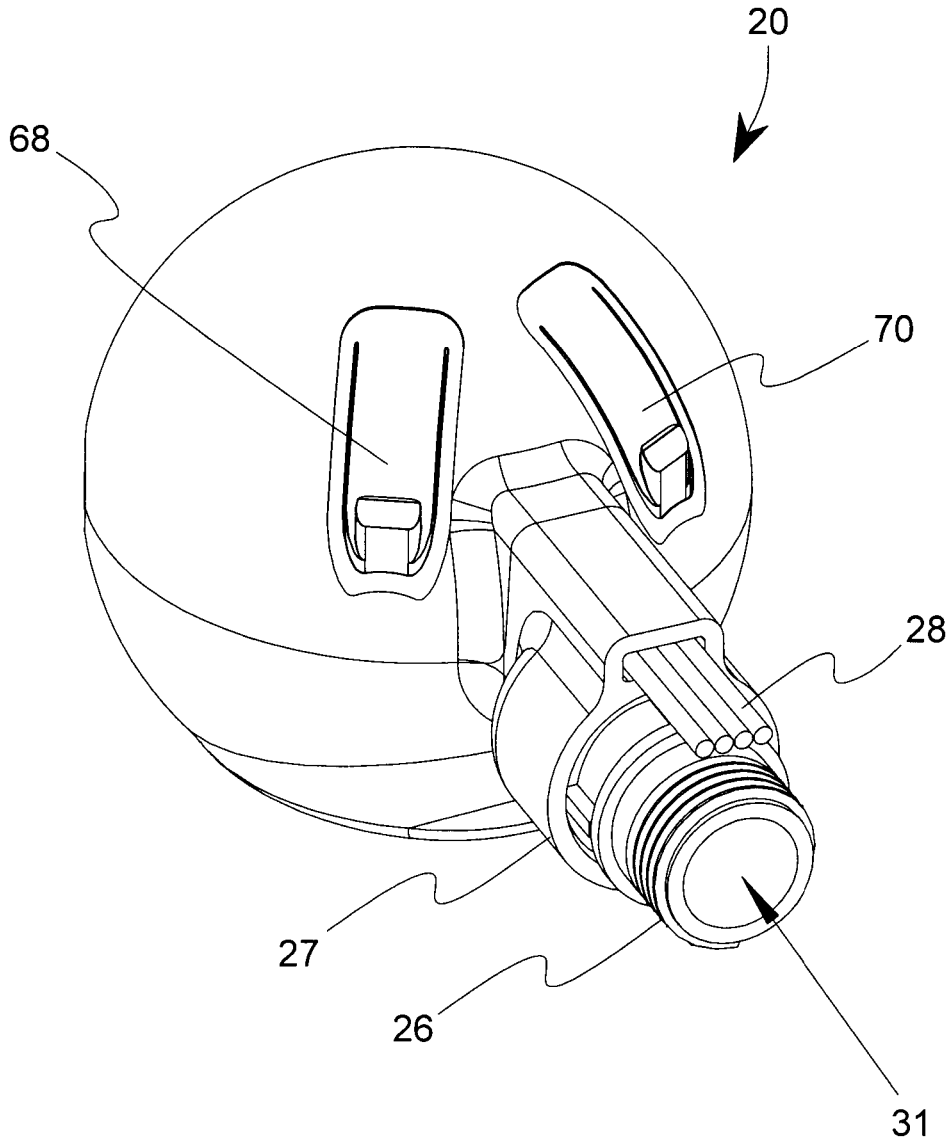
FIG. 4 is a rear isometric view of the spout head showing two switches for controlling flow rate or "on" and "off" spray function.
Figure 10:
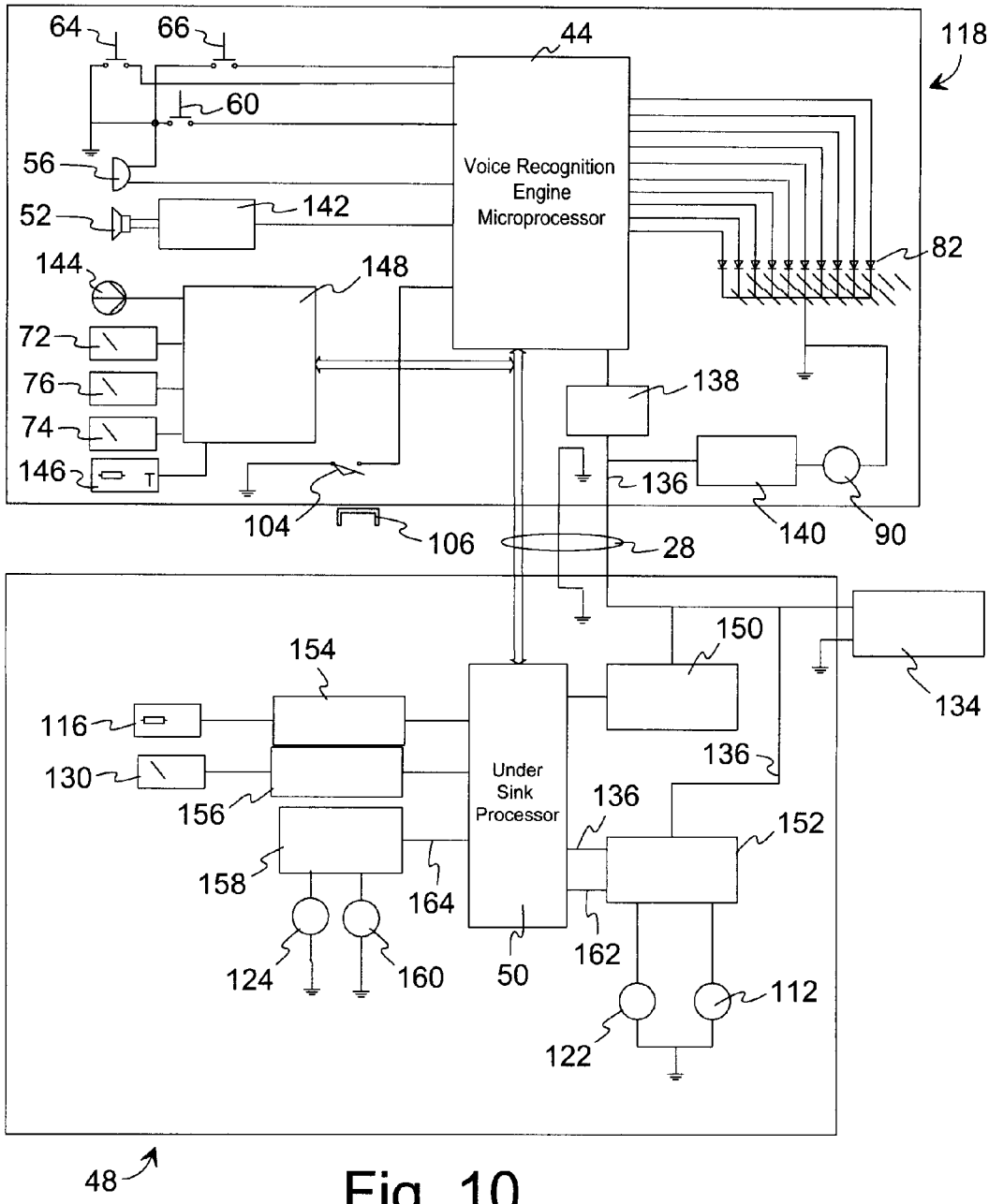
FIG. 10 is a schematic view of the control electronics in the spout head and the water control assembly.

As a means for monitoring configuration in real time and enabling control of certain sensors, the spout contains a magnetically operated reed switch (104), and the stem (22) contains a magnet (106), schematically shown in FIG. 10. The magnet (106) is placed such that when the spout head (22) is in home position in the stem, magnet (106) activates reed switch (104). Spout processor (44) detects that the spout (20) is in its home position and changes operating mode to enable the proximity sensors (72, 74, 76) for normal operation. When the spout (20) is removed as previously described, processor (44) initiates hand held spray mode, and the proximity sensors (72, 74, 76) are disabled to accommodate hand held operation of the spout head. As a means for monitoring angular position and controlling dispensing operations, FIG. 2 shows that the bottom of the spout contains a rotation 2-axis magnetic sensor (108). The sensor senses the angular rotation of a stem base magnet (110) relative to the fixed stem base, which correspondingly provides an angular position of the stem relative to the installed position of the faucet at a sink basin. The rotation sensor communicates this angular position information to an electronic controller such as processor (50). This rotation sensor is utilized in setup mode for the sink mapping function and used in normal mode to determine the angular position of the spout with respect to the basin. Spout position is monitored by electronic controller (50), which controls the availability of water flow with respect to spout position during normal operation, with the spout head in home position.

With reference to FIGS. 9 and 10, a temperature motor or mixing valve (112) in the water control assembly (32) performs mixing of hot and cold water from respective hot-water inlet (113) and cold-water inlet (114). The mixing valve (112) is operated by a motor (115) under control of the water controller electronics and temperature sensor (116) to maintain a constant preset temperature as determined by the settings from the spout head electronic controls (118). An optional local instant hot water tank (120) may provide the hot water at an elevated temperature above 120 F. degrees to reduce the transit time for delivering hot water.

The output of the mixing valve (112) is split into two separate paths. The first path is the normal flow path to the spout water connection. This path contains a motorized flow control valve (122) and a solenoid-operated "on" and "off" valve (124). The normal flow path is used for delivery of flow-controlled water to the spout (20). In conjunction with the settings determined by the spout processor (44), the water control processor (50) controls the motorized flow valve (122) to provide the desired flow rate at the spout.

The second path from mixing valve (112) is a specialized path providing means for controlling delivery of a fixed volume of water. This path contains a constant pressure regulator (126) to provide water at a fixed pressure into a precision orifice (128) to provide a controlled flow rate. A pressure transducer (130) monitors the output of the pressure regulator (126) to assist in controlling delivery of a specified volume of water. As an example, the second path is capable of delivering a measured amount of water such as four ounces or one cup. Under direction from the spout processor (44) and water control processor (50) operating suitable software, a timed delivery of water at a fixed flow rate is integrated in time to provide the desired volume. A time versus flow relationship is determined by the pressure and resistance to flow of the precision orifice. The user may calibrate this relationship in the home after installation, using the setup mode. The user may actuate volume delivery by oral command or by a switch sequence. When the faucet receives a command to dispense a fixed volume, the electronic controller acknowledges the command by issuing audible confirmation through speaker (52). When the faucet is prepared to dispense the fixed volume, another audible confirmation issues through speaker (52). An optional water filter (132) provides filtered water suitable for drinking through this path.

The entire faucet is powered by an AC adapter (134), which is plugged into an AC outlet under the sink and supplies unregulated power via lines (136), FIG. 10. The water control assembly may optionally contain a battery for providing emergency power to allow operation in the event of power failure.

In more detail, the electronic control system for the faucet as depicted in FIG. 10 is physically separated into two subassemblies, described previously. One subassembly is the spout electronics package (118), and the second subassembly is the water control electronics package (48) located below the sink. The two subassemblies communicate via the four wire cable (28) connecting the two, both providing power and communications via digital interface, of which the preferred embodiment uses the I2C standard protocol.

The spout contains components previously described and in addition has a power regulator (138) for the rest of the spout electronics, a power driver (140) such as a solenoid switch to operate the spray/stream solenoid (90), a speaker driver or amplifier (142), an accelerometer (144) to estimate the angular position of the spout, a temperature sensor (146) for over-temperature sensing such as scald detection, and finally an A/D converter (148) to convert the analog signals from the proximity sensors (72, 74, 76).

The water control electronics package (48) contains components previously described and in addition has a manual power switch (149), power regulator (150), flow and temperature motor drives (152), temperature sensor signal conditioning (154) to provide amplification into the integrated microprocessor (50) analog inputs, pressure sensor signal conditioning (156) similar to signal conditioning (154), and solenoid driver power switches (158) to drive the water "on" and "off" solenoids (160) and (124). Solenoid (160) is a precision flow solenoid located in the precision flow path from mixing valve (112). Solenoid (124) is a normal flow solenoid, located in the normal flow path from mixing valve (112). The circuitry for motor drive (152) contains limit switches that relay the limits of faucet travel to processor (50) through communications path (162). Control signals (164) drive the motor drive circuitry, which contains limit switches that relay the limits of travel through path (162) to the processor (50). These limits protect the valve bodies from damage of excess rotation.

The functioning of the entire faucet is controlled by software embedded in read only memory in both the spout processor (44) and the water control processor (50). This software implements the detection of all proximity events, switch presses, and voice commands and likewise controls the LED display, speech output and water control functions. In operation, primary control is assigned to the water control processor (50) to make all final decisions. The water control processor (50) polls the spout processor (44) to perform various functions, which include detecting events, directing the LED display to show the correct temperature, and when audible output is necessary, directing which words or tones to annunciate.

The water control processor (50) is responsible for the safe operation of the faucet and controls entry into a safety mode. Processor (50) monitors input from temperature sensor (146) and controls the temperature control motor (112) to maintain a constant temperature of choice through a conventional digital servo loop. If the temperature exceeds a predetermined safe limit while the faucet is in normal operating mode, a substantial portion of the LED display, such as the left half of the array, will flash to indicate a scald condition. The processor (50) will actuate safety mode and disable or delay the flow of water at water flow solenoid (122) unless safety mode has been purposely overridden. While in safety mode, the processor at least delays the touchless "on" function of water flow. In response to a touchless "on" command such as a sensed object below downward looking sensor (74) or a verbal "on" instruction received at the voice recognition sensor, the processor in safety mode will enable at least one audio signal to warn the user if water is about to emerge at a temperature exceeding the safe limit, such as 117 F. degrees. Manual "on" operation of the faucet remains possible for a predetermined duration. The electronic interface control will disable safety mode and revert to normal operation mode after water temperature falls below the predetermined unsafe temperature.

The foregoing description has disclosed a preferred arrangement and operation of electronic components within a faucet. The two processors (44) and (50) are disclosed to operate with communication and by allocating functions between them. Other allocations of functions are possible and equivalent. Various components such as sensors, a speaker, a microphone, LEDs, switches, solenoids, and others have been described as performing various functions and sometimes performing different or alternate functions according to different modes of faucet operation. Throughout, when a component is described as performing a function including a cognitive element, it should be understood that processor control provides the cognitive element, and suitable programming routines operate within the processors to enable the requisite cognitive monitoring, input, and output to operate the other components to achieve the stated functions. Further, although two processors or electronic controllers are disclosed, a single controller, the combination of both controllers, or other numbers and combinations of processors may be regarded as constituting an electronic controller or processing means for controlling the faucet.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A touchless water temperature and flow control faucet adapted for use with external sources of hot and cold water, the faucet comprising:

a faucet stem pivotally attached to a mounting base such that said stem has freedom of pivotal motion through an arc of stem movement with respect to the mounting base;

a water supply conduit extending through the stem and adapted for connection, in use, to external sources of hot and cold water;

a spout head comprising at least a partial sphere that is graspable by the palm of a hand wrapped over the head with fingers to the rear, having a bottom face with at least two selectable water outlets and carrying said water supply conduit joined at a water supply conduit connector at the rear face of the spout head and arranged for delivering water through a selected one of said water outlets, wherein said spout head is alternatively engagable with the stem wherein the stem supports the spout head for pivotal motion through said arc of stem movement and is removable from the stem for hand held use;

outlet selection means for variably selecting one of the water outlets to deliver water from said water supply conduit;

mixing means for variably mixing hot and cold water in the water supply conduit to adjust temperature;

flow rate adjusting means for varying water flow rate in said water supply conduit;

flow on-off selecting means for variably switching water flow "on" or "off" in the water supply conduit;

an electronic controller adapted to receive signals respectively indicative of a flow pattern selection, a water temperature, a flow rate, and an on-off flow selection, and in response, to control said outlet selection means, mixing means, flow adjusting means, and flow on-off selecting means;

a touchless and manual control user interface adapted, in use, to receive touchless or manual control instructions from a user and to send a corresponding signal to said electronic controller, wherein the touchless or manual control instructions vary parameters of delivered water selected from flow pattern, temperature, flow rate, on-off selection, and combinations thereof;

wherein, said user control interface is adapted to receive touchless instructions by voice activation based upon voice recognition of commands by a user;

wherein, said spout head carries said touchless and manual control user interface and a connection to said electronic controller, wherein a first manual control is located on the rear face of the spout head, laterally juxtaposed to said water supply connection at approximately a typical placement of a user's forefinger at the rear face of the spout head with the palm of the user's hand wrapped over the spout head to directly pull the spout head from the stem; and said water supply conduit connector extends from the rear face of said spout head and defines a tapered neck juxtaposed to the spout head.

2. The faucet of claim 1, wherein:

the touchless control interface comprises at least one touchless on-off sensor having a sensing field with predetermined range, with a minimum limit of the range spaced from the spout head by a predetermined distance to allow hand contact with the spout head without triggering sensor operation, with pre-established top and bottom height limits as a function of angular position and detecting when an object is present in the sensing field, determining the distance of the object from the sensor, and sending a signal to said controller indicative of an on-off flow selection instruction dependent upon the distance of the object from the sensor.

3. The faucet of claim 1, wherein:

said touchless control user interface comprises a proximity sensor located on said spout head and adapted to provide instructions for water temperature adjustment;

said proximity sensor is equipped with a sensing field with predetermined range, with a minimum limit of the range spaced from the sensor by a predetermined distance to allow hand contact with the spout head without triggering sensor operation; and further comprising means for detecting when the spout head is removed from said stem and in response thereto disabling said touchless control user interface with respect to instructions for water temperature adjustment.

4. The faucet of claim 1, wherein:

said water supply conduit provides at least first and second selectable path segments;

said first path segment comprises means for regulating water pressure, a precision orifice at a location downstream of said means for regulating water pressure, and means for monitoring water pressure at an output of said means for regulating water pressure, wherein said means for regulating water pressure outputs water at a fixed pressure to said precision orifice, thereby providing water at a controlled flow rate, and said precision orifice provides resistance to flow and outputs water at a controlled flow rate, thereby adapting the first path segment to provide fixed volume delivery of water;

said second path segment comprises a flow control valve adapting the second path segment to provide flow controlled water delivery, wherein said second path segment is relatively larger in size than said precision orifice;

said flow on-off selecting means variably switches water flow "on" or "off" selectively in the first or second path of the water supply conduit;

said electronic controller is further adapted to receive a user initiated signal indicative of a user preselected, measured volume of water to be delivered, and in response to select said first path segment, to turn on said flow on-off selecting means for flow through the first path segment, to receive water pressure readings from said means for monitoring water pressure, to derive the time necessary to deliver said measured volume of water through the first path segment; and to turn off said flow on-off selecting means with respect to the first path segment when the measured volume of water has been delivered.

5. The faucet of claim 1, further comprising:

a second manual control located on the rear face said spout head, juxtaposed to said tapered neck on an opposite lateral side thereof from said first manual control.

6. A touchless flow control faucet adapted for use with an external source of water, the faucet comprising:

a faucet stem pivotally attached to a mounting base such that said stem has freedom of pivotal motion through an arc of stem movement with respect to the mounting base;

a water supply conduit extending through the stem and adapted for connection, in use, to an external source of water, wherein said conduit includes at least a first selectable path segment that provides a fixed volume delivery of water, and a second selectable path segment that provides flow controlled delivery of water;

said first path segment comprises means for regulating water pressure, a precision orifice at a location downstream of said means for regulating water pressure, and means for monitoring water pressure at an output of said means for regulating water pressure, wherein said means for regulating water pressure outputs water at a fixed pressure to said precision orifice, thereby providing water at a controlled flow rate, and said precision orifice provides resistance to flow and outputs water at a controlled flow rate, thereby adapting the first path segment to provide fixed volume delivery of water;

said second path segment comprises a flow control valve adapting the second path segment to provide flow controlled water delivery, wherein said second path segment is relatively larger in size than said precision orifice;

a spout connected to said water supply conduit to receive water and having at least two selectable water outlets, each providing a different flow pattern, wherein the spout is arranged for delivering water through a selected one of said water outlets, wherein said spout is alternatively engagable with the stem, wherein when engaged with the stem, the stem supports the spout for pivotal motion through said arc of stem movement, and wherein the spout is removable from the stem for hand held use;

outlet selection means for variably selecting one of the water outlets to deliver water;

flow on-off selecting means for variably switching water flow "on" or "off" in said water supply conduit; and an electronic controller receiving a user initiated signal indicative of a user preselected, measured volume of water to be delivered, chosen from a plurality of available measured volumes of water, and in response selecting said first path segment and controlling said outlet selection means, turning on said flow on-off selecting means to allow water flow through the first path segment, receiving water pressure readings from said means for monitoring water pressure in the first path segment, deriving the time necessary to deliver the measured volume of water; and turning off said flow on-off selecting means to end water flow through the first path segment when the measured volume of water has been delivered.

7. The faucet of claim 6, further comprising:

a local instant hot water tank proximate to said mixing means and supplemental to said external source of water, connected to the mixing means and locally supplying hot water to said water supply conduit.

8. The faucet of claim 6, further comprising:

said water supply conduit is adapted for connection, in use, to plural external sources of water, including an external source of hot water and an external source of cold water, wherein said conduit further provides a second selectable path segment delivering water to said spout;

mixing means for variably mixing hot and cold water in the water supply conduit to adjust temperature of delivered water;

flow rate adjusting means for varying water flow rate in at least said second path of the water supply conduit; and wherein said flow on-off selecting means switches water flow "on" or "off" selectively in the first or second path of the water supply conduit;

wherein said electronic controller further receives user initiated signals respectively indicative of a desired outlet selection, a desired water temperature selection, a desired flow rate selection, and a desired on-off flow selection for water delivery through the second path segment, and in response, further controls said outlet selection means, said mixing means, said flow rate adjusting means, and the flow on-off selecting means for water delivery through at least the second path segment; and a touchless control user interface adapted, in use, to receive touchless control instructions from a user and to send a corresponding signal to said electronic controller, wherein the touchless control instructions vary parameters of delivered water selected from outlet, temperature, flow rate, on-off selection, and combinations thereof.

9. The faucet of claim 8, wherein:

said spout carries said touchless control user interface;

the touchless control user interface comprises at least one touchless on-off sensor having a sensing field with predetermined range, with a minimum limit of the range spaced from the spout by a predetermined distance to allow hand contact with the spout without triggering sensor operation, with pre-established top and bottom height limits as a function of angular position and detecting when an object is present in the sensing field, determining the distance of the object from the sensor, and sending a signal to said controller indicative of an on-off flow selection instruction dependent upon the distance of the object from the sensor.

10. The faucet of claim 8, wherein:

said touchless control user interface comprises a proximity sensor located on said spout and providing instructions for water temperature adjustment;

said proximity sensor is equipped with a sensing field with predetermined range, with a minimum limit of the range spaced from the sensor by a predetermined distance to allow hand contact with the spout without triggering sensor operation; and further comprising means for detecting when the spout is removed from said stem and in response thereto disabling said touchless control user interface with respect to instructions for water temperature adjustment.

11. The faucet of claim 8, wherein:

said spout carries said touchless control user interface and a connection to said electronic controller;

exclusive of connections to the electronic controller and water supply conduit, the spout is configured as a hand-graspable ball.

12. The faucet of claim 8, wherein:

said spout carries said touchless control user interface;

the touchless control interface comprises at least one touchless on-off sensor having a sensing field with predetermined range, with a minimum limit of the range spaced from the spout by a predetermined distance to allow hand contact with the spout without triggering sensor operation, with pre-established top and bottom height limits as a function of angular position and detecting when an object is present in the sensing field, determining the distance of the object from the sensor, and sending a signal to said controller indicative of an on-off flow selection instruction dependent upon the distance of the object from the sensor.

13. The faucet of claim 6, further comprising:

a temperature sensor communicating actual water temperature to said electronic controller; and a series array of indicator lights capable of selectively displaying at least two colors, located on said spout, wherein said array is responsive to water temperature selection at said control user interface to indicate selected water temperature by lighting a first indicator light of a first color within said array at a proportional location in the array indicating temperature setting, and wherein the array is responsive to the electronic controller by indicating the actual water temperature by lighting a second indicator light of a second color within the array at a proportional location in the array indicating actual water temperature; and wherein the electronic controller provides updates of actual water temperature, and in response thereto, said series array of indicator lights updates the position of the second light in the array.

14. A touchless water temperature and flow control faucet adapted for use with external sources of hot and cold water, the faucet comprising:

a faucet stem pivotally attached to a mounting base such that said stem has freedom of pivotal motion through an arc of stem movement with respect to the mounting base;

a water supply conduit extending through the stem and adapted for connection, in use, to external sources of hot and cold water;

a spout engagable with the stem in a home position in which the stem supports the spout for pivotal motion through said arc of stem movement, and wherein the spout is connected to said water supply conduit for receiving water into the spout;

an electronic controller adapted to selectively establish at least a setup mode and a normal mode of faucet operations;

angle monitoring means for monitoring and communicating angular position of the faucet stem with respect to said mounting base to said electronic controller;

a downward directed sensor in said spout controlled by said electronic controller such that when the electronic controller is in setup mode and the stem is moved through the arc of stem movement, the downward directed sensor maps the particular external contours below the spout over the arc of stem movement and communicates mapping data to the electronic controller, and when the electronic controller is in normal mode, the downward directed sensor monitors the area intermediate the downward directed sensor and the mapped contour below the sensor to detect, in use, the presence of an object other than a mapped contour and to communicate data indicative of the detected object to the electronic controller;

water temperature adjusting means for variably mixing hot and cold water from said sources of hot and cold water in the water supply conduit;

a temperature sensor measuring actual water temperature in the water supply conduit and providing a signal indicative of measured water temperature;

flow rate adjusting means for varying water flow rate in the water supply conduit;

flow on-off selecting means for variably switching water flow on or off in the water supply conduit;

a user control interface adapted to receive user control instructions indicating desired water temperature and desired flow rate and to send a corresponding signal to said electronic controller;

wherein the electronic controller is adapted to receive data from said angle monitoring means and the downward directed sensor, when in setup mode establishing and retaining a map, and when in normal mode determining an on-off flow selection by decision derived from a comparison to said retained map, and wherein the electronic controller is further adapted to receive said signal indicative of measured water temperature and said user control instructions from said user control interface respectively indicative of user-desired water temperature and user-desired flow rate, and in response to control said water temperature adjusting means and flow rate adjusting means; and a series array of indicator lights capable of selectively displaying at least two colors, located on said spout, wherein said array is responsive to said user control instruction indicating desired water temperature by lighting an indicator light of a first color within said array at a proportional location in the array indicating desired temperature, and wherein the array is responsive to the electronic controller by indicating the actual water temperature by lighting an indicator light of a second color within the array at a proportional location in the array indicating actual water temperature.

15. The faucet of claim 14, further comprising:

means for delivering a fixed volume of water;

wherein said electronic controller is further adapted in normal mode to control said means for delivering a fixed volume of water; and said user control interface is further adapted, in use, to receive touchless control instructions from a user selecting delivery of a fixed volume of water and to correspondingly signal said electronic controller.

16. The faucet of claim 14, wherein:

said angle monitoring means is an accelerometer in said spout.

17. The faucet of claim 14, wherein said downward directed sensor comprises at least one touchless on-off sensor having a downward directed sensing field, adapted in setup mode to detect a dynamic field of acceptable faucet operation with bottom plane and top plane as a function of spout angle, and adapted in normal mode to sense relative height of a detected external object relative to the dynamic field of acceptable faucet operation, and to send a signal to said electronic controller indicative of an on-off flow selection instruction dependent upon the height of the detected object in the dynamic field of acceptable faucet operation.

18. The faucet of claim 14, wherein said user control interface is adapted to receive touchless instructions by voice activation based upon voice recognition of commands by a user.

19. The faucet of claim 14, wherein said spout further comprises:

a nozzle connected to said water supply conduit and providing at least two water outlets, each having a different water flow pattern;

flow pattern selection means for variably selecting a water outlet from said at least two water outlets for receiving water from the water supply conduit; and said user control interface is further adapted, in use, to receive touchless control instructions from a user selecting flow pattern and to correspondingly signal said electronic controller to select a water outlet.

20. The faucet of claim 14, wherein said user control interface is adapted to receive voice recognition input signals to vary on-off flow selection, adjust water temperature, control flow rate, select delivery of a fixed volume of water, select a water outlet, or combinations thereof.

21. The faucet of claim 14, wherein said user control interface includes touchless proximity sensors carried on said spout, adapted to provide instructions for water temperature adjustment, further comprising:

means for detecting when the spout is removed from said stem and in response thereto disabling said touchless proximity sensors with respect to instructions for water temperature adjustment.

22. The faucet of claim 14, wherein:

said spout carries said user control interface and a connection to said electronic controller;

exclusive of connections to the electronic controller and water supply conduit, the spout is configured as a hand-graspable sphere.

* * * * *